US007806583B2

(12) United States Patent
Oswald

(10) Patent No.: US 7,806,583 B2
(45) Date of Patent: Oct. 5, 2010

(54) CLAMPING MECHANISM

(76) Inventor: Fred Oswald, 27 Forest Dr., Sands Point, NY (US) 11050

( * ) Notice: Subject to any disclaimer, the term of this patent is extended or adjusted under 35 U.S.C. 154(b) by 905 days.

(21) Appl. No.: 11/705,704

(22) Filed: Feb. 13, 2007

(65) Prior Publication Data

US 2007/0195639 A1 Aug. 23, 2007

Related U.S. Application Data

(60) Provisional application No. 60/774,400, filed on Feb. 17, 2006.

(51) Int. Cl.
*B28C 5/48* (2006.01)
*B01F 11/00* (2006.01)

(52) U.S. Cl. ..... 366/123; 366/128

(58) Field of Classification Search ..... 366/117, 366/118, 120, 123, 128; 279/93, 94; 403/188, 403/189, 391

See application file for complete search history.

(56) References Cited

U.S. PATENT DOCUMENTS 158,276 A * 12/1874 Hitchings et al. ..... 403/189
762,285 A * 6/1904 Crone ..... 188/231
1,889,983 A * 12/1932 Gavard ..... 125/22
2,522,906 A * 9/1950 Smith ..... 211/1.51
2,942,314 A * 6/1960 Debner et al. ..... 403/391
3,216,471 A * 11/1965 Wendel ..... 81/436
3,767,841 A * 10/1973 Anderson et al. ..... 174/84 C
2003/0111753 A1* 6/2003 Oswald et al. ..... 264/35
2004/0208080 A1* 10/2004 Oswald et al. ..... 366/123

OTHER PUBLICATIONS

"Rebar Rocker Northrock Industries, Inc.", *Concrete Construction*, Jan. 2005, pp. 1 and 146.
"Exhibitor Information Manua[I]," CONEXPO-CON/AGG 2005 and IFPE 2005, Mar. 15-19, 2005.

* cited by examiner

*Primary Examiner*—David L Sorkin
(74) *Attorney, Agent, or Firm*—Ladas & Parry LLP

(57) ABSTRACT

A clamping mechanism particularly for clamping a vibrator to a reinforcing bar. The clamping mechanism provides a slot which intersects a channel. The channel is longitudinally open in one direction at one side of said intersecting slot and longitudinally open in the opposite direction at the other side of said intersecting slot. A reinforcing bar or other member to be engaged first enters the slot then moves into the channel. Once in the channel, the bar or other member is positively retained therein.

20 Claims, 6 Drawing Sheets

CLAMPING MECHANISM

This application claims the benefit of U.S. Provisional Application No. 60/774,400, filed Feb. 17, 2006, and incorporates same by reference.

BACKGROUND OF THE INVENTION

The invention relates to a clamping mechanism and is particularly concerned with the clamping of a vibrator to a reinforcing bar.

In the construction industry, it is frequently necessary to lay a large area of concrete. Such areas can include, for example, foundations for buildings, floors, driveways, columns, walls, ramps, etc.

Concrete is a mixture of cement, sand, and stones, Lime is an ingredient in cement, and water is mixed with the components of the mixture to activate the lime and form a mix or slurry. Concrete exhibits characteristics of strength in compression but is relatively weak in tension.

To increase strength in tension, it is common practice to prepare a grid of reinforcing bars ("rebars") and then to pour concrete over and around the grid, so that the reinforcing bars improve the tension strength of the poured concrete. After the wet concrete has been poured over and around the grid of reinforcing bars, it is common practice in the art to vibrate the concrete to remove air and voids from the poured mix. In this manner, when the concrete hardens, the slab will be more compact and undesirable pockets within the hardened concrete are avoided, without compromising the integrity of the concrete.

The most common form of concrete vibrator comprises a metal cylinder within which a shaft carrying an eccentric weight is rotatable to cause the metal cylinder to vibrate. The cylinder is mounted on one end of a flexible drive which serves to rotate the shaft and hence vibrate the cylinder. When the vibrating cylinder is introduced into, and immersed in, the wet concrete mix or slurry, vibrations—which may be in the region of 10,000 per minute—agitate the slurry to an extent sufficient to remove air and voids from the slurry.

Another method involves imparting vibrations to the slurry through vibrating the reinforcing bar themselves. Top-mounted vibrators are described in U.S. Pat. No. 6,950,011 and JP 07048927. But these vibrators have certain problems. If a reinforcing bar is too tall—for example, it projects a distance above scaffolding—it is too high for the vibrator operator to reach the top of the bar and the vibrator cannot be mounted for use. A top-mounted vibrator also cannot be used if the end of the reinforcing bar is bent or hooked. Also, if a plurality of reinforcing bars are incorporated in a grid, there may be no individual bars with upwardly projecting ends for mounting in a vibrator.

SUMMARY OF THE INVENTION

It has therefore been found desirable to mount a vibrator laterally on the side of a reinforcing bar or on such a bar incorporated in a grid. A quick engagement/release mechanism enables an operator to switch the vibrator from bar to bar in an assembly of bars or grid and thereby impart vibrations through an area of slurry.

According to the present invention, there is provided a clamping mechanism including a frame, a channel within said frame, and a slot extending across said frame and intersecting said channel, said channel being longitudinally open in one direction at one side of said intersecting slot and longitudinally open in the opposite direction at the other side of said intersecting slot whereby an elongated member can be positioned in said slot and said clamping mechanism then turned in a direction in which portions of said elongated member on opposite sides of said slot respectively pass through the longitudinal open portions of the channel to a position in which the elongated member lies in and longitudinally along said channel.

According to a further aspect of the invention, there is provided a vibrator attachable to a bar, said vibrator including a casing, means within said casing for vibrating said casing, and a clamp associated with said casing for engaging a bar, said clamp including a frame, a channel extending longitudinally through said frame, a slot extending across said frame and intersecting said channel at a location intermediate the ends thereof, said channel being longitudinally open in one direction at one side of said intersecting slot and longitudinally open in the opposite direction at the other side of said intersecting slot, said channel, said channel openings, and said intersecting slot all being dimensioned to accommodate said bar whereby said slot can be seated over said bar to adopt a position in which said bar lies across said channel whereupon the frame encompassing the elongated channel can be rotated in a direction in which a portion of the bar to one side of the slot passes through the longitudinal channel opening on said one side of the slot and a portion of the bar to the opposite side of the slot passes through the oppositely directed longitudinal channel opening on the opposite side of the slot to a position in which said bar lies in and along said channel within the frame.

According to a still further aspect of the invention, there is provided a method of preparing a concrete structure including the steps of forming an area to confine the structure, positioning at least one reinforcing bar in the confined area, pouring a concrete slurry into said confined area to surround and partially envelope said at least one reinforcing bar, engaging said at last one reinforcing bar by a vibrator according to claim 3 such that said bar lies in the slot and across the channel, rotating said vibrator to move said engaged bar from said slot into said channel, orienting said vibrator to create an interference hold between the channel walls and the bar, and activating said vibrator to vibrate said at least one reinforcing bar and impart vibrations into the surrounding slurry.

DESCRIPTION OF THE DRAWINGS

The invention will now be described with reference to the accompanying drawings in which.

DESCRIPTION OF PREFERRED EMBODIMENTS

Figure 1:
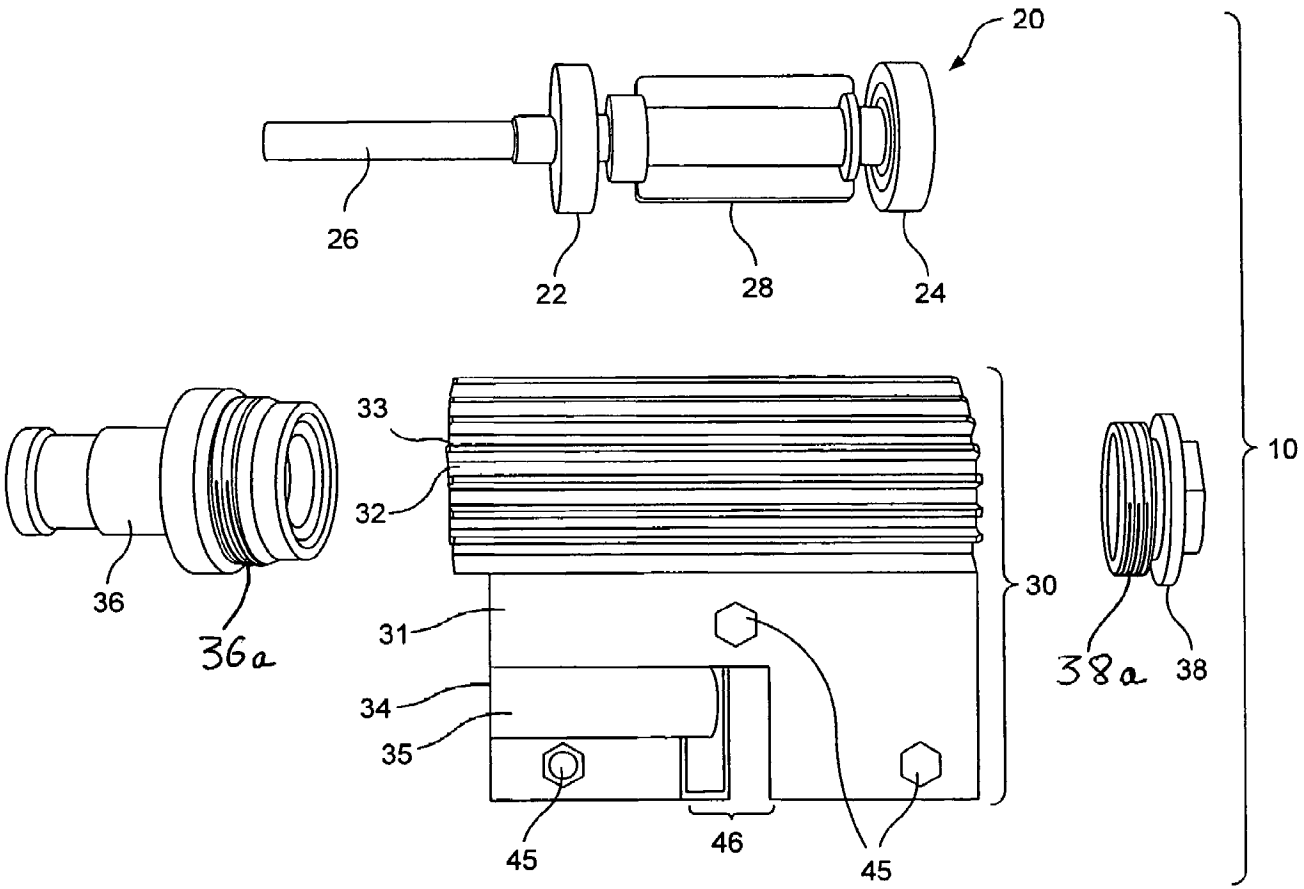
FIG. 1 shown an exploded view of a vibrator.

Referring now to the drawings, and specifically to FIG. 1, a vibrator 10 includes a housing 30 including a cylindrical vibration portion 32 and a clamping portion 31. In the preferred embodiment, most clearly shown in FIGS. 2A and 2C of the drawings, the cylindrical vibration portion 32 and the clamping portion 31 are two parts of an integral casing. However, the cylindrical portion 32 and the clamping portion 31 could be separate components secured to each other. Such separate components could be secured to each other by, for example, mating keyways, bolts, rivets, or like fasteners. However, in operation, the vibrator vibrates on the order of 10,000 vibrations per minute and separate components could, in some circumstances, create problems. Thus, in the preferred embodiment the cylindrical portion and the clamping portion are an integral unit, and the unit could be an integral casting of, for example, aluminum or the two component portions could be permanently welded together. The actual vibrating mechanism is, essentially, of conventional construction and vibrations are caused by rotating an eccentric weight at high speeds.

To this end, the vibrating mechanism includes a rotatable shaft 26 disposed coaxially within the cylindrical vibration portion 32. Bearings 22 and 24 accommodated within the cylindrical portion permit free rotation of the shaft therewithin, and an eccentric weight carried by the shaft will impart vibrations to the housing 30 when the shaft 26 is rotated at high speed. The eccentric weight 28 can be keyed or otherwise secured on the shaft or, preferably, the shaft can comprise two or more axially aligned coupled segments and the eccentric weight can be a unitary casting with one such segment.

The shaft and eccentric weight are rotatable at speeds of the order of 10,000 revs per minute by an external power source (not shown) which is connected to the rotatable shaft by a flexible drive 14 coupled to the drive shaft 26 via a coupling 36. The coupling 36 seals one end of the cylindrical portion 32 and protects the bearing 22. The opposite end of the cylindrical portion 32 is closed by a cap 38 which similarly seals the remote end of the vibrator housing and protects the bearing 24. In the embodiment shown in the drawings, the coupling 36 and cap 38 are provided with respective screw-threaded portions 36*a* and 38*a* which engage with mating threaded portions (not shown) at opposite ends of the interior of the cylindrical portion 32.

With the operational high rate of revolutions and the vibrations imparted thereby, heat generation has to be addressed and a plurality of cooling fins are provided to dissipate the heat generated. These cooling fins 33 are shown in FIG. 1 (but, for clarity, omitted from FIGS. 2A and 2C) extending along the length of the cylindrical portion 32 and projecting radially therefrom with intervening spaces therebetween.

The above-described vibrator is attachable to a reinforcing bar 12 by a quick clamping mechanism which will now be described in detail.

Figure 2A:
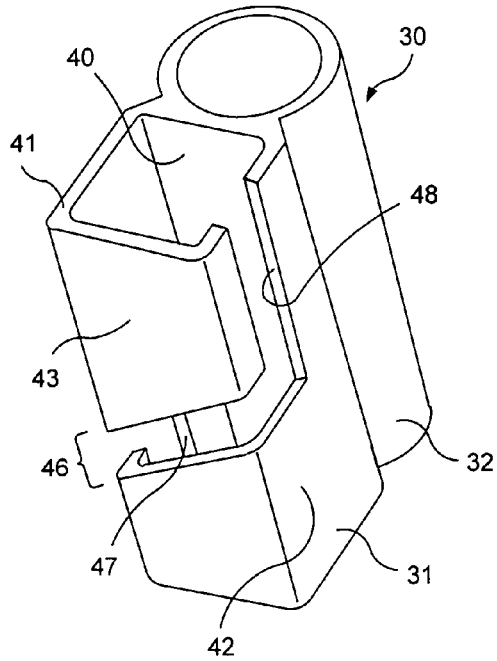
FIG. 2A shows a perspective view of a housing of the vibrator.

The clamping portion 31 is best shown in FIG. 2A of the drawings and, as described in the preceding paragraphs, is preferably a unitary casting with the cylindrical portion 30. The clamping portion 31 comprises a box-like frame having a base 40 adjacent the cylindrical portion 32, side wall portions 41, 42 upstanding from said base, and a top portion 43. The base, side wall portions, and top portion are shown respectively disposed at right angles to each other and define a rectangular channel dimensioned snugly to accommodate a firm but resilient insert 44. It will be appreciated that both the frame and the reinforcing bar are metallic and the provision of an intervening resilient insert avoids having metal on metal in an environment subjected to high frequency vibrations. The insert is preferably a molding of urethane or similar polymeric material and, in addition to being snugly seated within the channel, is preferably secured in position by fasteners 45. In the embodiment shown in the drawings, the fasteners are bolts which extend through the side wall portions of the frame and through mating bores in the insert. It will, however, be appreciated that secure fastening could be achieved by means other than bolts extending through the side walls and could, for example, include screw-threaded fastening plugs extending through the top portion 43 into the insert 44. Whatever the form of fasteners used to secure the insert, the insert will be interchangeable and can readily be replaced by a new insert when worn by the operational vibrations.

A slot 46 extends through the top portion 43 and down and part way through the side wall portions 41 and 42. In the embodiment shown in the drawings, the slot 46 is shown extending at an angle across and through the top portion and, although the slot could extend transversely across the top portion (i.e., at right angles to the side portions 41, 42) an angle in the range from 15 degrees to 45 degrees from the transverse is preferred, since orientation of the slot at an acute angle will reduce the extent to which the vibrator must be rotated to seat a reinforcing bar in a channel in the insert in the manner described in the following paragraphs.

The slot terminates part way through the side portions 41 and 42 and, from the lowermost extremity of the slot 46, a further slot 47 extends longitudinally through the side wall portion 41 to the end of the rectangular channel adjacent the cap 38 and a similar slot 48 extends longitudinally through the side wall portion 42 to the end of the channel adjacent the coupling 36.

This arrangement of slots 46, 47, and 48 results in the channel being longitudinally open in one direction in one side wall from one side of the slot 46 and longitudinally open in the opposite direction in the opposite side wall from the other side of the slot 46.

Figure 2B:
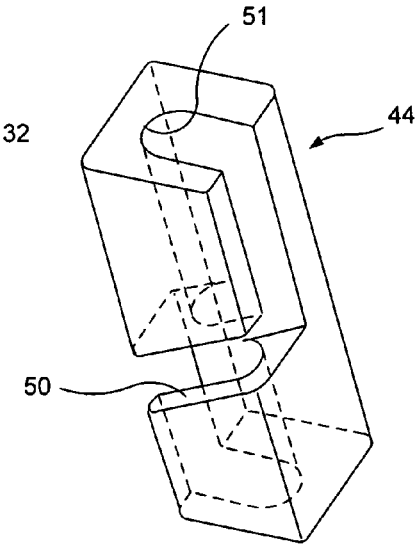
FIG. 2B shows a perspective view of an insert accommodated in the vibrator housing.
Figure 2C:
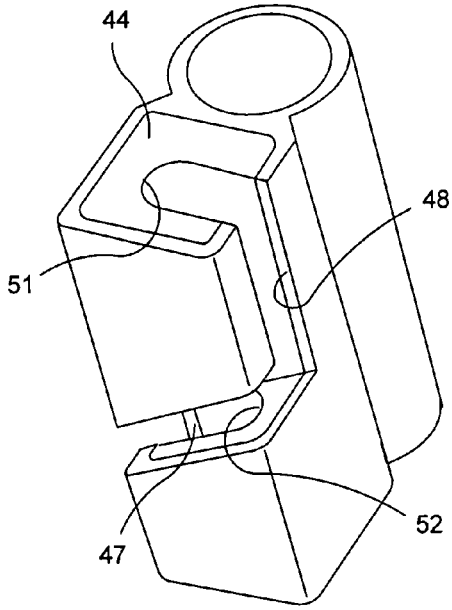
FIG. 2C shows an exploded view of the vibrator housing shown in FIG. 2A with the insert shown in FIG. 2B in position.

The insert 44, best shown in FIG. 2B of the drawings, is a block of material similarly configured with a slot 50 extending from one side thereof partway through the block towards the other side to intersect a channel 51 extending longitudinally through the block. That channel 51 is open in one direction to mate with the slot 47 in the side wall portion 41 of the frame and, from the slot 50, is open in the opposite direction to mate with the slot 48 formed in the other side wall portion 42 of the frame.

The manner of attaching the vibrator to a reinforcing bar will now be described.

The vibrator 10 is attached to the flexible drive 14 by means of the coupling 36 and, with the remote end of the flexible drive 14 connected to a power source, is ready for use. An area of concrete to be set has already been prepared by assembling forming to confine the area, the reinforcing bar or grid of reinforcing bars has been assembled and emplaced within the area and liquid concrete slurry has been poured into the confined area around the reinforcing bar or bars. The area to be cast can be any typical in the construction industry including, but not limited to, a floor slab, a wall, a ramp, a step or steps, etc.

The vibrator is then mounted on a reinforcing bar, either an individual bar or a component or a grid of such bars, in the following manner. The bar or grid component does not necessarily have to be upright or transversely extending to receive the vibrator but can be oriented in any desired direction.

Figure 3:
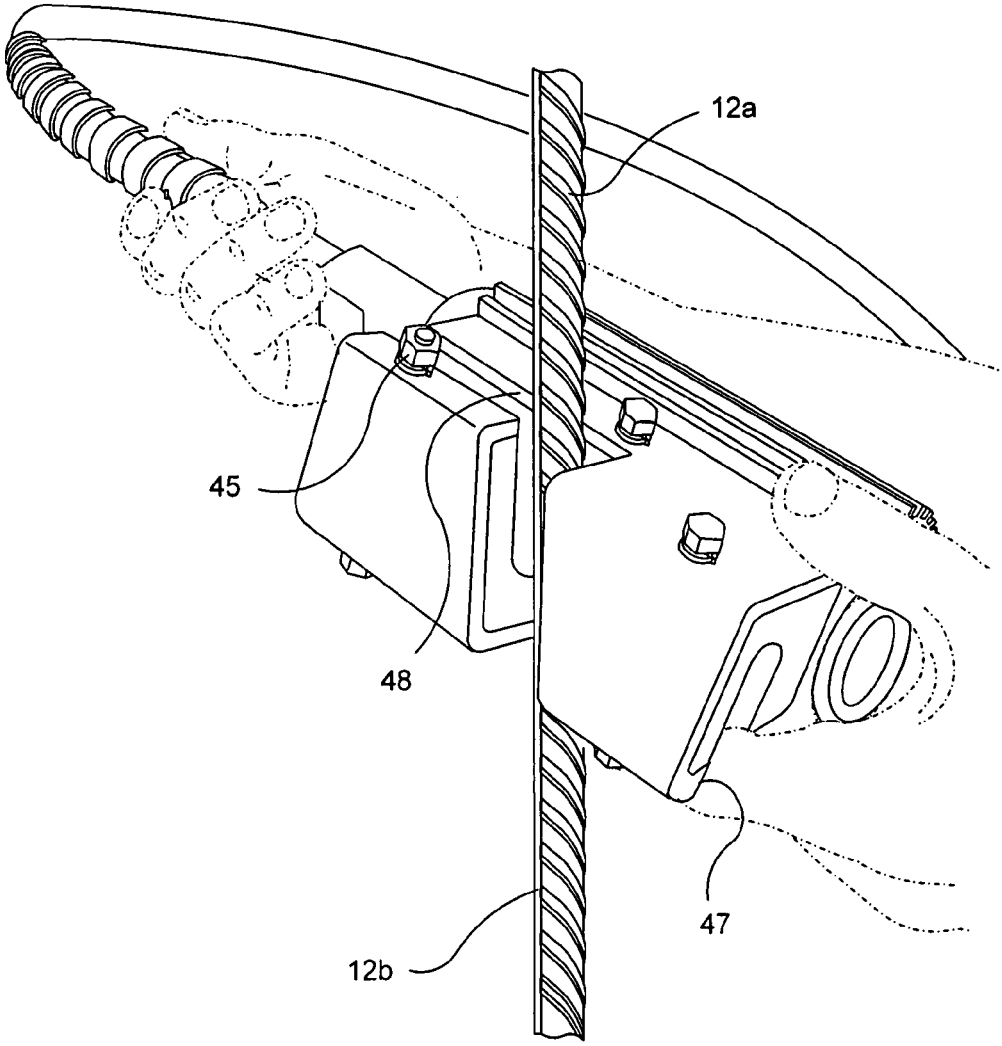
FIG. 3 shows a first step in the mounting of the vibrator on a reinforcing bar.
Figure 4:
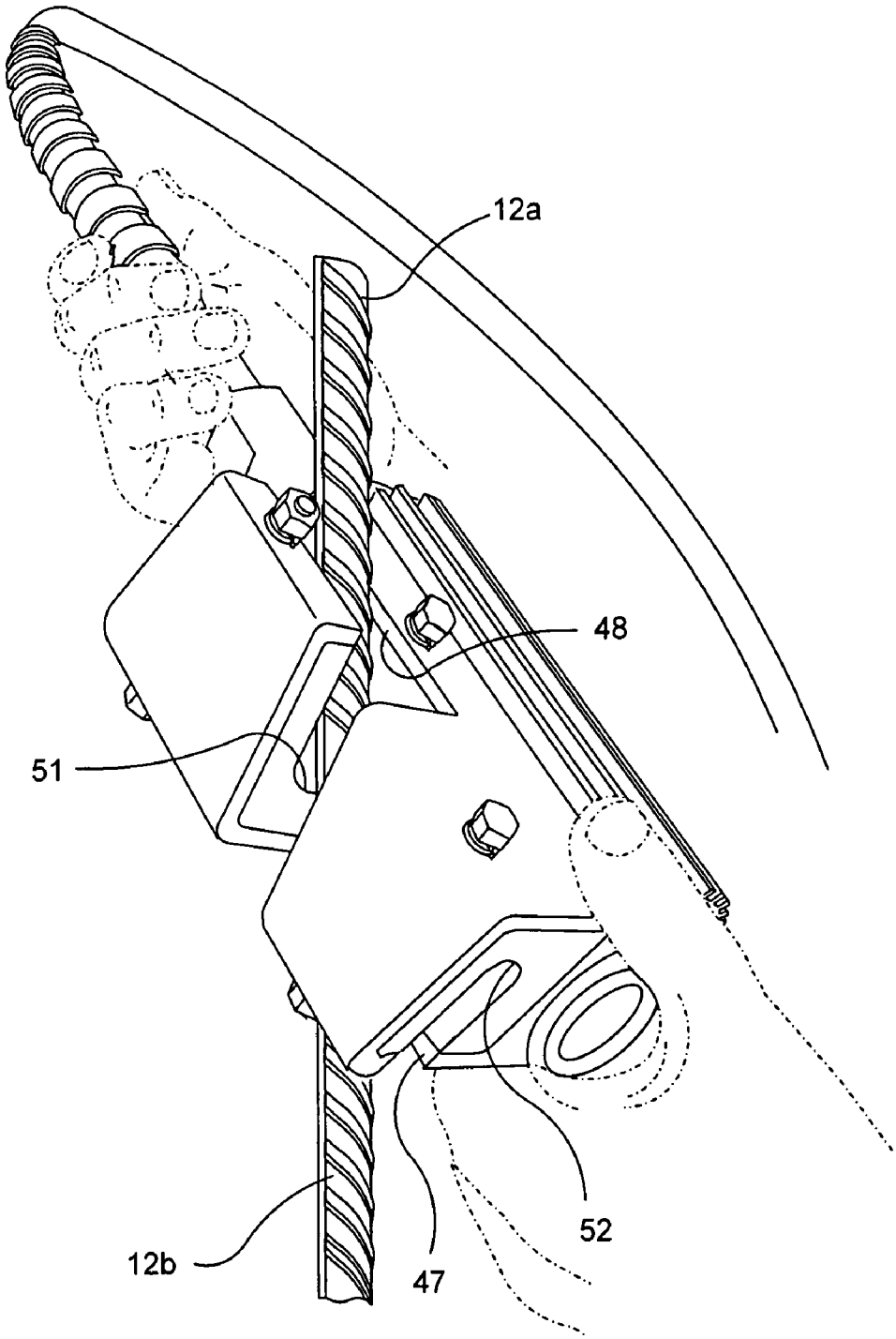
FIG. 4 shows a subsequent step of the mounting of the vibrator on the reinforcing bar.

The hand-held vibrator is introduced to the bar by passing the bar into and through the slot 46 to lie against the bottom of the slot in the manner shown in FIG. 3 of the drawings. Thereupon, the vibrator is oriented or rotated in a clockwise direction, still with respect to FIG. 3, in which the upper portion 12*a* of the bar 12 enters and passes through the slot 48 in the side wall portion 42 of the frame and the lower portion 12*b* of the bar similarly enters and passes through the slot 47 in the side wall portion 41. FIG. 4 of the drawings shows the vibrator during this orienting or rotating step with the respective portions 12*a* , 12*b* of the reinforcing bar entering and passing through the slots 48, 47.

As the rotation of the vibrator is continued the upper portion 12*a* of the reinforcing bar will pass into the channel 51 in the insert 44 which is firmly retained in the frame, and the bottom portion 12*b* of the reinforcing bar will similarly pass into aligned channel 52 in the insert 44. When the reinforcing bar portions 12*a* , 12*b* abut or lie along the bottoms of the respective channel portions there can be no further orientation or rotation of the vibrator which is thus firmly seated on the reinforcing bar.

Figure 5:
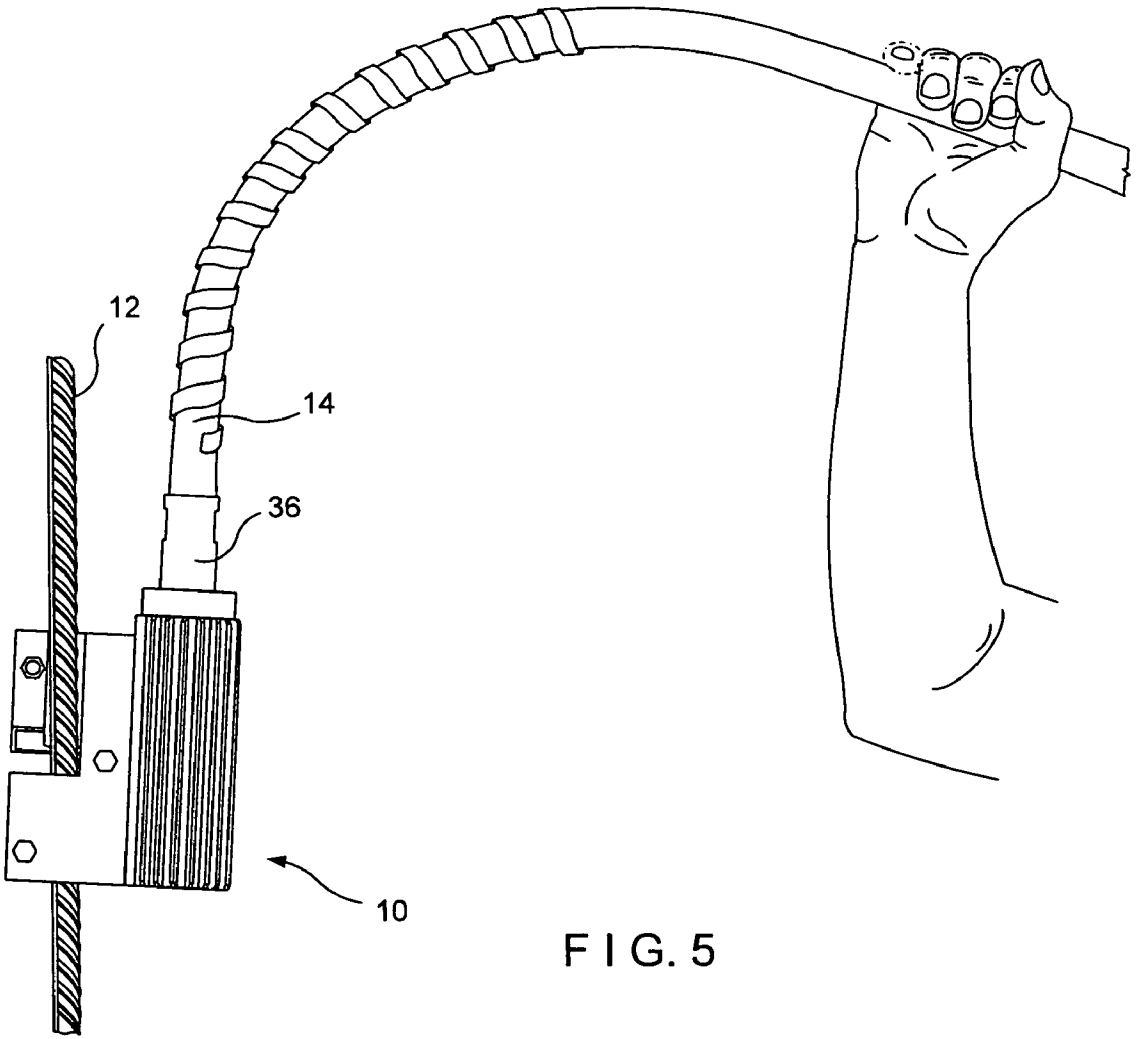
FIG. 5 shows a front elevation of the vibrator mounted on the reinforcing bar.
Figure 7:
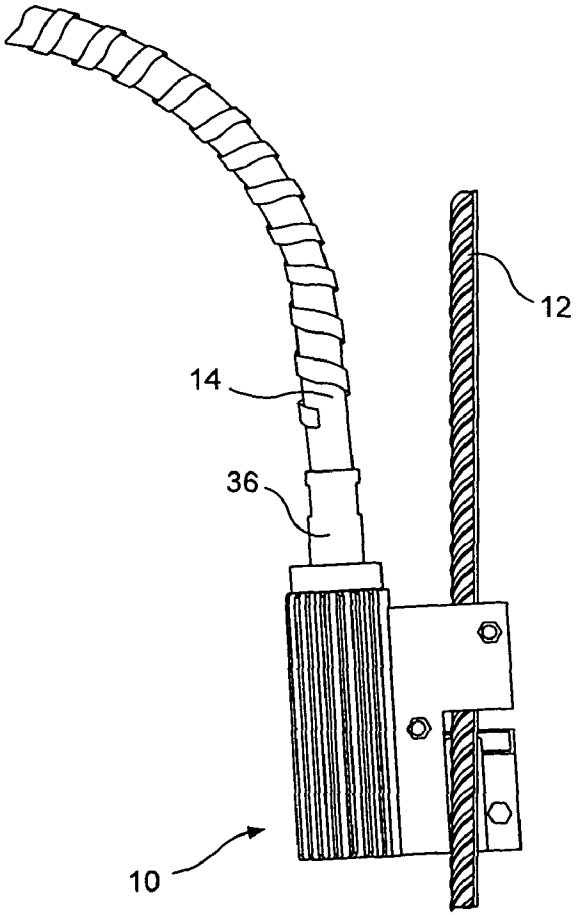
FIG. 7 shows a rear elevation of the vibrator mounted on the reinforcing bar.
Figure 6:
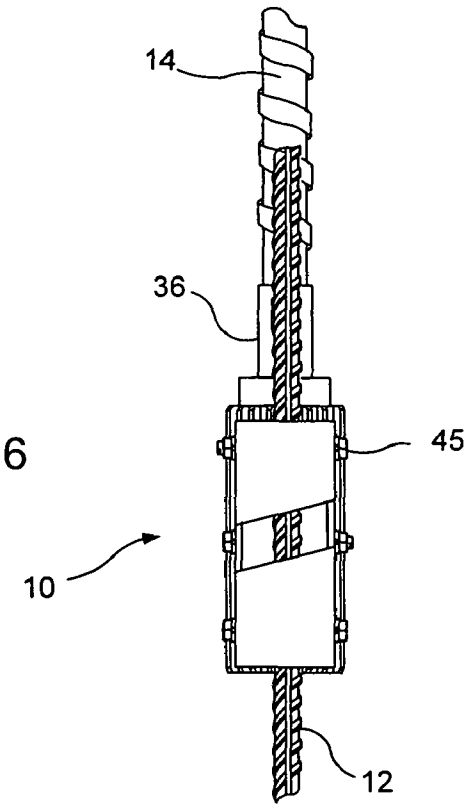
FIG. 6 shows a side elevation of the vibrator mounted on the reinforcing bar.

It is then only necessary to ensure firm retention of the vibrator thus mounted on the reinforcing bar and ensure not only that the vibrator does not slip up or down the bar but that the retention is sufficiently firm to prevent any chatter caused by the high-frequency vibrations generated by the vibrator. This could be accomplished by providing locking means in the form of a thumbscrew extending through one of the side wall portions 41, 42 or top portion of the frame or providing an equivalent lever operated cam locking arrangement. Although such locking means (not shown) would accomplish the desired result, the provision of such means would detract from the simplicity and easy operability of the clamping mechanism of the invention. The preferred method of firmly retaining the mounted vibrator on the reinforcing bar is by hand holding the flexible drive and applying a force to tilt the mounted vibrator away from the reinforcing bar in the manner most clearly shown in FIG. 5 of the drawings. This tilting of the mounted vibrator will cause an interference jamming by opposing side wall portions of the insert channels 51, 52 on the reinforcing bar.

In the embodiment shown in the drawings, the channels 51, 52 are straight-sided with rounded bottoms. The channels, however, could be keyhole-shaped in cross section or, preferably, vee-shaped. An advantage of vee-shaped channels having tapering side walls is that it can accommodated reinforcing bars of different diameters since the smaller the diameter the further the bar will penetrate the channel but will still firmly contact the tapering walls not only to provide an interference fit but also to eliminate or minimize chatter.

Although the embodiments of the clamping mechanism described and shown in the drawings have particular relevance to the clamping of a vibrator on a reinforcing bar, it will be appreciated that the "slot and channels" arrangement is suitable for use in other fields where it is designed to clamp a component on to an elongated member regardless of the orientation of such member. Thus, the member can be, for example, standing upright or lying in a transverse direction.

The invention claimed is:

1. A vibrator attachable to a bar, said vibrator including a casing, means within said casing for vibrating said casing, and a clamp associated with said casing for engaging a bar, said clamp including a frame, a channel extending longitudinally through said frame, a slot extending across said frame and intersecting said channel at a location intermediate the ends thereof, said channel being longitudinally open in one direction at one side of said intersecting slot and longitudinally open in the opposite direction at the other side of said intersecting slot, said channel, said channel openings, and said intersecting slot all being dimensioned to accommodate said bar whereby said slot can be seated over said bar to adopt a position in which said bar lies across said channel whereupon the frame encompassing the elongated channel can be rotated in a direction in which a portion of the bar to one side of the slot passes through the longitudinal channel opening on said one side of the slot and a portion of the bar to the opposite side of the slot passes through the oppositely directed longitudinal channel opening on the opposite side of the slot to a position in which said bar lies in and along said channel within the frame.

2. A vibrator as claimed in claim 1, wherein the frame is integral with the vibrator casing.

3. A vibrator as claimed in claim 2, wherein the frame and casing are a unified casting.

4. A vibrator as claimed in claim 3, wherein the frame and casing are cast from aluminum.

5. A vibrator as claimed in claim 2, wherein the vibrator casing is of an elongated cylindrical form and has a longitudinal axis substantially parallel to the longitudinal axis of the channel extending through the frame.

6. A vibrator as claimed in claim 1, wherein the longitudinal axis of the slot is offset at an acute angle with respect to the longitudinal axis of the channel.

7. A vibrator as claimed in claim 6, where the angular offset is in the range 15 degrees to 45 degrees.

8. A vibrator as claimed in claim 1, wherein an insert is secured within the frame and wherein a longitudinal bore through said insert defines the channel.

9. A vibrator as claimed in claim 8, wherein the channel is straight-side with a rounded bottom.

10. A vibrator as claimed in claim 9, wherein the opposed straight sides of the channel are substantially parallel.

11. A vibrator as claimed in claim 8, wherein the insert is a block of polymeric material.

12. A vibrator as claimed in claim 11, wherein the insert is urethane.

13. A vibrator as claimed in claim 8, wherein the insert is secured in the channel by at least one fastener.

14. A vibrator as claimed in claim 1, wherein a shaft driveable by an external source is rotatable within the casing and wherein an eccentric weight is secured to said drive shaft within said casing.

15. A vibrator as claimed in claim 14, wherein the casing is cylindrical in cross section and wherein the drive shaft is coaxially located in said cylindrical casing.

16. A vibrator as claimed in claim 15, wherein cooling fins project radially outwardly from at least a portion of the external peripheral surface of the cylindrical casing.

17. A vibrator as claimed in claim 16, wherein a base of the frame extends along one side of the cylindrical casing and wherein each radially projecting cooling fan extends longitudinally along the length of the cylindrical casing, said fins being spaced from each other and projecting from at least a portion of said casing bordering said base of the frame.

18. A method of preparing a concrete structure including the steps of forming an area to confine the structure, positioning at least one reinforcing bar in the confined area, pouring a concrete slurry into said confined area to surround and partially envelope said at least one reinforcing bar, engaging said at least one reinforcing bar by a vibrator according to claim 3 such that said bar lies in the slot and across the channel, rotating said vibrator to move said engaged bar from said slot into said channel, orienting said vibrator to create an interference hold between the channel walls and the bar, and activating said vibrator to vibrate said at least one reinforcing bar and impart vibrations into the surrounding slurry.

19. A method as claimed in claim 18, wherein the vibrator is activated by a flexible drive and wherein said flexible drive is positioned to maintain the vibrator in a tilted position with respect to the reinforcing bar lying in the channel to create said interference hold between said vibrator and reinforcing bar.

20. A method as claimed in claim 18, wherein the reinforcing bar is part of an assembled grid of reinforcing bars and wherein said grid is vibrated by said vibrator.

* * * * *